US007821762B2

(12) United States Patent
Yasuoka et al.

(10) Patent No.: US 7,821,762 B2
(45) Date of Patent: Oct. 26, 2010

(54) PIEZOELECTRIC TRANSFORMER TYPE IONIZER AND NEUTRALIZATION METHOD

(75) Inventors: Koichi Yasuoka, Meguro-ku (JP); Yuki Shibata, Meguro-ku (JP); Nobuhiro Fujiwara, Tsukubamirai (JP); Satoshi Suzuki, Tsukubamirai (JP); Toshio Sato, Tsukubamirai (JP)

(73) Assignee: SMC Corporation, Tokyo (JP)

( * ) Notice: Subject to any disclaimer, the term of this patent is extended or adjusted under 35 U.S.C. 154(b) by 162 days.

(21) Appl. No.: 12/265,978

(22) Filed: Nov. 6, 2008

(65) Prior Publication Data

US 2009/0135538 A1 May 28, 2009

(30) Foreign Application Priority Data

Nov. 22, 2007 (JP) ..... 2007-302844

(51) Int. Cl.
*H05F 3/00* (2006.01)

(52) U.S. Cl. ..... 361/212; 361/213

(58) Field of Classification Search ..... 361/212, 361/213; 310/311, 318

See application file for complete search history.

(56) References Cited

U.S. PATENT DOCUMENTS 7,375,945 B2 * 5/2008 Izumi et al. ..... 361/231
2007/0159762 A1 * 7/2007 Okano ..... 361/212

FOREIGN PATENT DOCUMENTS

JP 10-302994 11/1998

* cited by examiner

*Primary Examiner*—Danny Nguyen
(74) *Attorney, Agent, or Firm*—Oblon, Spivak, McClelland, Maier & Neustadt, L.L.P.

(57) ABSTRACT

With a piezoelectric transformer formed of a ferroelectric element which generates a high voltage in a secondary section upon application of an AC voltage to a primary section, ground electrodes are attached to upper and lower surfaces of the secondary section of the piezoelectric transformer via a dielectric sheet for insulation in tight contact therewith such that a dielectric barrier discharge occurs around the ground electrodes to generate positive and negative ions, and an air flow is injected from an air nozzle to flow toward a neutralized subject across the ground electrodes.

14 Claims, 2 Drawing Sheets

PIEZOELECTRIC TRANSFORMER TYPE IONIZER AND NEUTRALIZATION METHOD

TECHNICAL FIELD

The present invention relates to an ionizer for neutralizing electrostatically charged works using a piezoelectric transformer, and a neutralization method using the ionizer.

BACKGROUND ART

An ionizer which allows a piezoelectric transformer to generate a high voltage so as to be applied to a needle electrode for generating ions has been known as disclosed in Patent Document 1, Japanese Unexamined Patent Application Publication No. 10-302994. The ionizer is operated using the high voltage generated at a secondary section of the piezoelectric transformer upon application of AC low voltage to a primary section thereof. As disclosed in Patent Document 1, the high voltage generated in the secondary section (output side) is applied to a needle electrode for generating ions.

In the ionizer using the piezoelectric transformer, as the electric field is focused onto a top end of the needle electrode to generate ions, the top end is likely to be locally deteriorated. This may cause metal particles to scatter, and as a result, the neutralizing performance becomes deteriorated in a short period. As the needle electrode has a narrow ion generation region, the resultant ion generation amount is small. The ion generation amount may be increased by raising the voltage. However, the electric field at the top end of the needle electrode becomes so intense that generation of ozone which exhibits strong oxidative power is facilitated.

DISCLOSURE OF INVENTION

It is an object of the present invention to provide a piezoelectric transformer type ionizer and a neutralization method using the piezoelectric transformer for overcoming the disadvantage of the generally employed ionizer using the piezoelectric transformer, that is, the needle electrode which causes the local deterioration and scattering of the metal particles to deteriorate the neutralizing performance in a short period such that highly accurate neutralization is maintained for a long period to prolong the maintenance interval and to simplify the maintenance work while holding an ion balance in good condition.

The present invention provides a piezoelectric transformer type ionizer having a piezoelectric transformer formed of a ferroelectric element, and an air nozzle which injects an air flow toward a neutralized subject. The piezoelectric transformer includes a primary section to which an AC voltage for driving is applied, and a secondary section for generating a high voltage. Metal wire-like ground electrodes are attached to an outer surface of the secondary section via a dielectric sheet for insulation in tight contact therewith, and cause a dielectric barrier discharge around the ground electrodes to generate positive and negative ions. The air nozzle is disposed to allow the air flow passing the ground electrodes to feed the ion toward the neutralized subject.

According to the present invention, preferably, the piezoelectric transformer has a thin and long rectangular solid shape with one half in a length direction of the piezoelectric transformer formed as the primary section, and the other half formed as the secondary section. The ground electrode is attached to at least one of an upper surface and a lower surface of the secondary section so as to extend in a width direction of the piezoelectric transformer.

More preferably, the ground electrodes are attached to the upper surface and the lower surface of the secondary section of the piezoelectric transformer. The ground electrodes attached to the upper surface are as many as the ground electrodes attached to the lower surface. The ground electrodes attached to the upper and the lower surfaces are arranged at corresponding positions.

According to the present invention, preferably, the air nozzle is disposed such that the air flow from the air nozzle flows along an outer surface of the piezoelectric transformer in a direction orthogonal to the ground electrode.

According to the present invention, preferably, the dielectric sheet is formed of a polyimide film. Preferably, the ground electrode is formed of a metal wire adhered to the dielectric sheet or a metal film printed to or vapor deposited on the dielectric sheet.

The embodiment according to the present invention includes a voltage generator for outputting an AC voltage to be applied to the primary section of the piezoelectric transformer, a sensor for measuring a charged potential level of the neutralized subject, and a control circuit which feedbacks a signal measured by the sensor to the voltage generator to control an ionic balance.

The voltage generator formed of a DC power supply, an oscillation circuit, and a semiconductor switching element for switching between opposing poles based on an output of the oscillation circuit is structured to output the AC voltage with a rectangular switching waveform. The control circuit is structured to control a switching frequency of the voltage generator in accordance with a signal measured by the sensor.

In the neutralization method using an ionizer with a piezoelectric transformer which includes a primary section to which a driving AC voltage is applied and a secondary section for generating a high voltage to have a thin metal wire-like ground electrode attached to an outer surface of the secondary section via a dielectric sheet for insulation in tight contact therewith, the high voltage is generated in the secondary section by applying the AC voltage to the primary section of the piezoelectric transformer to generate a dielectric barrier discharge around the ground electrode on the dielectric sheet and to produce positive and negative ions, and concurrently an air flow is allowed to flow toward a neutralized subject from an air nozzle while passing a position where the ground electrode is disposed.

The present invention provides an ionizer capable of maintaining a highly accurate neutralization for a long period using the piezoelectric transformer, and prolonging the maintenance interval and simplifying the maintenance work while holding the ion balance in a good condition, and a neutralization method using the ionizer.

BEST MODE FOR CARRYING OUT THE INVENTION

Figure 1:
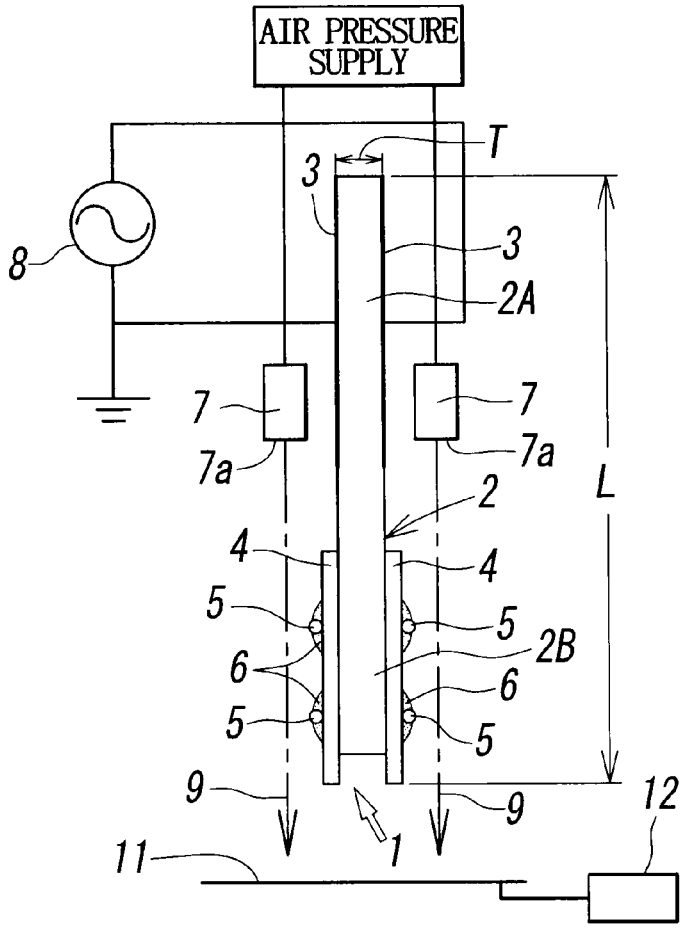
FIG. 1 is a side view schematically showing an embodiment of an ionizer according to the present invention.

An embodiment of the present invention will be described in detail referring to the drawings.

Figure 2:
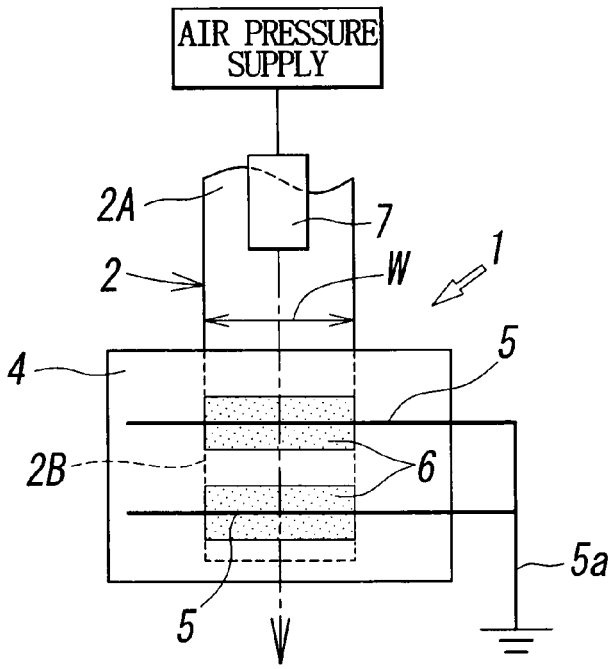
FIG. 2 is a front view schematically showing the embodiment.
Figure 3:
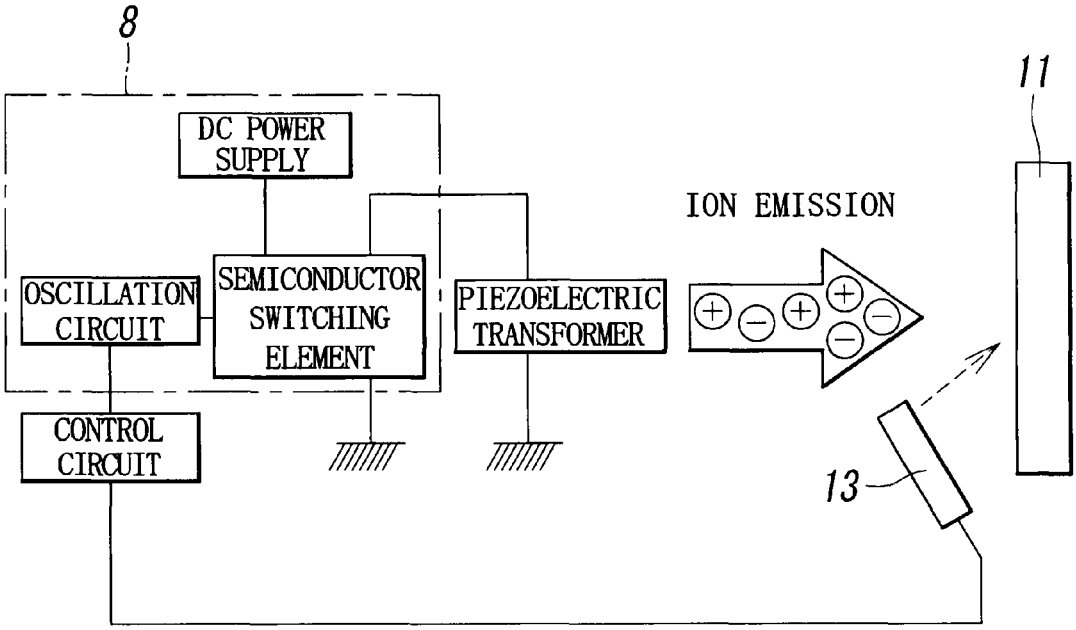
FIG. 3 is a block diagram showing an exemplary structure of a voltage generator.

FIGS. 1 and 2 show an example of an ionizer according to the present invention. The ionizer which uses a piezoelectric transformer 1 formed of a ferroelectric element 2, for example, a PZT (Piezoelectric Zirconate Titanate) with intrinsic polarization has a high voltage surface of the piezoelectric transformer 1 used as a planar high voltage electrode. The piezoelectric transformer 1 allows charges to be induced on an outer surface of a secondary section 2B in response to application of AC voltage to both surfaces of a primary section 2A in a thickness T direction. The piezoelectric transformer 1 is used as the electrode for generating ions. Unlike the generally employed structure having the high voltage of the piezoelectric transformer directly applied to the needle electrode to cause the local deterioration or scattering of metal particles, the present invention is capable of maintaining highly accurate neutralization for a long period to prolong the maintenance interval while holding the ions in good balance.

More specifically, the piezoelectric transformer 1 of Rosen type is formed of the ferroelectric element 2 with a rectangular solid body having a long side in one direction and a thickness T smaller than a lateral width W. One half of the piezoelectric transformer 1, that is, the ferroelectric element 2 in a length L direction is intrinsically polarized as the primary section 2A in the thickness T direction. The other half is intrinsically polarized as the secondary section 2B in the length L direction. Current application electrodes 3 are formed by vapor depositing metal on both upper and lower surfaces of the primary section 2A of the ferroelectric element 2 in the thickness T direction. When the AC voltage is applied from a voltage generator 8 to the primary section 2A via the current application electrode 3, an AC field is formed in the thickness T direction of the ferroelectric element 2. The primary section 2A elastically oscillates in the length L direction under the inverse piezoelectric effect. The resultant frequency is equal to the frequency of the applied voltage. Resonance of the whole element occurs at a certain frequency to cause strong mechanical vibration. As the secondary section 2B elongates and contracts in the length L direction at this time, the piezoelectric effect induces the charge on the secondary section 2B.

A ground electrode 5 like a thin metal wire is attached to each flat surface of the upper and lower surfaces of the secondary section 2B of the piezoelectric transformer 1 in tight contact therewith via a dielectric sheet 4, and grounded via a ground line 5*a*. In other words, the dielectric sheet 4 is adhered to each of the upper and lower surfaces of the secondary section 2B. At least one of the aforementioned ground electrodes 5 is attached to the surface of the dielectric sheet 4 in tight contact therewith. Referring to the drawing, two ground electrodes 5 are disposed in parallel with each other toward the width W direction as an equipotential direction in each maximum voltage generation region on the upper and the lower surfaces of the secondary section 2B. The ground electrodes 5 on the upper and the lower surfaces are positioned opposite with each other with respect to the ferroelectric element 2 and the dielectric sheets 4. The respective positions of the ground electrodes 5 on the upper and the lower surfaces may be different in the length L direction of the piezoelectric transformer 1.

The high voltage surface of the secondary section 2B of the piezoelectric transformer 1 is used as the planar high voltage electrode of the ionizer, and the ground electrode 5 like the thin metal wire is disposed on the outer surface of the secondary section 2B in tight contact therewith via the dielectric sheet 4. As a result, the high voltage generated in the secondary section 2B generates a dielectric barrier discharge, that is, AC corona discharge around the ground electrode 5 via the dielectric sheet 4. A plasma 6 of the dielectric barrier discharge serves to ionize gas molecules contained in air for producing positive and negative ions for neutralization. In the barrier discharge, the charged particles which have moved in space upon discharge are partially ionized, or the neutral particles are ionized to generate ions. The resultant ions are partially discharged to outside the plasma. As a result, the ion discharge amount is dependent on the discharge intensity level.

An insulating polymer film, for example, polyimide film is suitable for the dielectric sheet 4. However, other material, for example, a thin plate such as a glass may be employed without being limited to the one as described above. The ground electrode 5 may be formed by attaching a conductive metal wire to the dielectric sheet 4 through adhesion or any other process. An uneven gap between the metal wire and the dielectric sheet 4 may develop deterioration or wear due to concentrated discharge. It is required to be provided in tight contact with the dielectric sheet 4. In the above aspect, it is preferable to allow the ground electrode 5 to be printed onto the dielectric sheet 4, or to be formed of a vapor deposited metal film.

When the dielectric sheet 4 is formed of a hard material like a glass, a certain consideration is required for bonding such dielectric sheet to the piezoelectric transformer 1, for example, to use a tape-like cushioning material therebetween so as not to interfere with the mechanical vibration of the piezoelectric transformer 1.

The ionizer includes air nozzles 7 connected to an air pressure supply such as a compressor for blowing ions generated by the AC corona discharge around the ground electrodes 5 to a neutralized subject 11 such as a charged work. The air nozzles 7 are disposed on the upper and lower surfaces of the piezoelectric transformer 1 each having an air outlet 7*a* directed to a longitudinal direction of the piezoelectric transformer 1. An air flow 9 injected from the air outlet 7*a* moves along the outer surface of the piezoelectric transformer 1 in the direction orthogonal to the ground electrode 5 on the dielectric sheet 4. The air flow which contains ions is sprayed to the charged neutralized subject 11 so as to be neutralized. The single air nozzle 7 which is structured to inject air therefrom along the upper and the lower surfaces of the piezoelectric transformer 1 may be employed.

Referring to FIG. 1, a charge plate is employed as the neutralized subject 11. The charge plate 11 is used for measuring the neutralizing property of the ionizer as the model of the neutralized subject. A charge plate monitor 12 is used for observing and recording the change in the potential of the charge plate 11.

The voltage generator 8 outputs the AC voltage at the frequency for causing the resonance of the piezoelectric transformer 1 so as to be applied thereto. The output waveform may be a sinusoidal waveform or a rectangular switching waveform. The inventor confirms that the pressure rising ratio of the secondary section 2B varies depending on the waveform of the voltage applied to the primary section 2A of the piezoelectric transformer 1, and the pressure rising ratio of the voltage at the secondary section upon input of the rectangular switching wave is higher than the one upon input of the sinusoidal wave from the experimental results. It is therefore preferable to use the rectangular switching waveform rather than the sinusoidal waveform.

When the output waveform of the voltage generator 8 is set to the rectangular switching waveform, it is structured to include a DC power source from 24 to 40 V, an oscillation circuit, and a semiconductor switching element such as an FET (Field Effect Transistor) for switching the pole based on the output of the oscillation circuit. As a result, the AC (rectangular AC) with the rectangular switching waveform at approximately 35 kHz may be obtained. The voltage generator 8 disposed around the piezoelectric transformer 1 allows the ionizer to be easily formed in principle as a compact and simple structure while performing highly accurate ion balancing. The ionizer may further be simply structured to be operated by supplying only DC voltage.

The ionizer has a creepage surface barrier structure where the dielectric sheet 4 and the ground electrode 5 are disposed on the ferroelectric element 2 as the aforementioned piezoelectric transformer 1. In this case, the creeping discharge type varies in accordance with the pole of the electrode. When the ion balance biases to the positive side, the resultant difference is marked. Accordingly, it would appear that the positive ion generation amount changes depending on the current intensity of the creeping discharge. The highly accurate ion balance may be realized under the control with the input voltage or frequency of the piezoelectric transformer 1.

The ionizer may be provided with a surface potential sensor 13 disposed opposite the neutralized subject 11 for detecting its charge potential level, and a control circuit for performing a feedback with respect to the charge potential level detected by the sensor 13 to the voltage generator 8 using a signal for adjusting a switching frequency for the ion balance control. This makes it possible to realize the highly accurate control with the ion balance feedback control. Specifically, when the side of the neutralized subject 11 becomes positive, the drive voltage applied to the PZT ferroelectric element 2 is lowered, or gradually shifting the drive resonance frequency from the resonance point. When the side of the neutralization becomes negative, the inverse control may be executed.

The above-structured ionizer of piezoelectric transformer type may be driven by a rectangular wave formed by the semiconductor switching element upon application of DC 24V. This makes it possible to realize a light-weight and compact structure. The use of the dielectric barrier discharge allows generation of positive and negative ions simultaneously to uniformly distribute the positive and negative ions with no uneven neutralization. The inverse charge may be controlled to be set to 0 V to provide the highly accurate neutralizing property. Furthermore, the secondary voltage may be controlled by changing the voltage value or frequency of the drive voltage for the piezoelectric transformer, thus controlling the ion balance with high accuracy.

EMBODIMENT

A thin rectangular solid shaped PZT piezoelectric transformer of Rosen type with length of 50 mm, width of 13 mm, and thickness of 2 mm was used as the piezoelectric transformer 1 as shown in FIGS. 1 and 2. Metal vapor deposition was performed on both upper and lower surfaces of the primary section 2A of the piezoelectric transformer 1 to form the electrode 3. Meanwhile, a polyimide film with thickness of 175 μm was applied to the upper and the lower surfaces of the secondary section 2B for insulation. Two tungsten wires each with the radius of 100 μm were adhered onto the polyimide film toward a width W direction as the equipotential direction to form the ground electrode 5 for grounding ends of all the wires. The resonance frequency standard value of the PZT piezoelectric transformer was as low as 33 kHz.

Two air nozzles 7 connected to the compressor were disposed to allow the compressed air to flow along the upper and lower surfaces of the secondary section 2B of the piezoelectric transformer 1 in the direction orthogonal to the tungsten wire. The flow rate of the air flow was 10 l/min, the flow speed 1 cm downstream of the piezoelectric transformer was 7.5 m/s, and 6 cm downstream was 4.0 m/s, respectively.

The neutralizing property of the ionizer was measured using the charge plate 11 modeled as a charged structure to be neutralized at a position downstream of the air flow. The charge plate monitor 12 applied a predetermined charge to the charge plate 11 for neutralizing with ions of air from the ionizer. The change in the resultant potential was observed and recorded.

Figure 4:
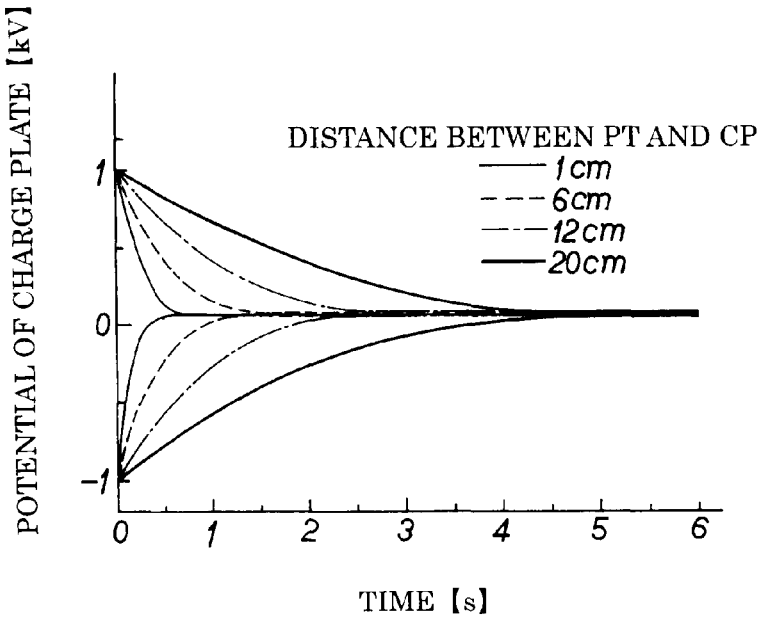
FIG. 4 is a graph showing an experimental result with respect to a neutralizing speed of the ionizer according to the present invention.

The input voltage to the primary section 2A of the piezoelectric transformer 1 was 40 V, and the resonance frequency was 35.83 kHz. FIG. 4 shows the change in a neutralizing speed at a charge plate potential of +/−1 kV upon change in the distance from the piezoelectric transformer (PT) to the charge plate (CP) 11. Referring to the drawing, in the embodiment, the neutralizing speed observed a high value corresponding to that of the needle electrode under the DC operation. As the final potential becomes approximately 0, the ion balance is in good condition.

The ionizer according to embodiment is provided with a plurality of ground electrodes 5 on the upper and lower surfaces of the secondary section 2B of the piezoelectric transformer 1. However, the single ground electrode 5 may be employed. Alternatively, the number of the ground electrodes to be formed on the upper surface may be different from that of the ground electrodes to be formed on the lower surface. Furthermore, at least one of the ground electrodes may be provided on either one of the upper and the lower surfaces of the piezoelectric transformer 1.

The invention claimed is:

1. A piezoelectric transformer type ionizer comprising a piezoelectric transformer formed of a ferroelectric element, and an air nozzle which injects an air flow toward a neutralized subject, wherein:

the piezoelectric transformer includes a primary section to which an AC voltage for driving is applied, and a secondary section for generating a high voltage, metal wire-like ground electrodes are attached to an outer surface of the secondary section via a dielectric sheet for insulation in tight contact therewith, and cause a dielectric barrier discharge around the ground electrodes to generate positive and negative ions; and the air nozzle is disposed to allow the air flow passing the ground electrodes to feed the ion toward the neutralized subject.

2. The ionizer according to claim 1, wherein:

the piezoelectric transformer has a thin and long rectangular solid shape with one half in a length direction of the piezoelectric transformer formed as the primary section, and the other half formed as the secondary section; and the ground electrode is attached to at least one of an upper surface and a lower surface of the secondary section so as to extend in a width (W) direction of the piezoelectric transformer.

3. The ionizer according to claim 2, wherein the ground electrodes are attached to the upper surface and the lower surface of the secondary section of the piezoelectric transformer;

the ground electrodes attached to the upper surface are as many as the ground electrodes attached to the lower surface; and the ground electrodes attached to the upper and the lower surfaces are arranged at corresponding positions.

4. The ionizer according to claim 2, wherein the air nozzle is disposed such that the air flow from the air nozzle flows along an outer surface of the piezoelectric transformer in a direction orthogonal to the ground electrode.

5. The ionizer according to claim 3, wherein the air nozzle is disposed such that the air flow from the air nozzle flows along an outer surface of the piezoelectric transformer in a direction orthogonal to the ground electrode.

6. The ionizer according to claim 1, wherein the dielectric sheet is formed of a polyimide film.

7. The ionizer according to claim 2, wherein the dielectric sheet is formed of a polyimide film.

8. The ionizer according to claim 1, wherein the ground electrode is formed of a metal wire adhered to the dielectric sheet or a metal film printed to or vapor deposited on the dielectric sheet.

9. The ionizer according to claim 2, wherein the ground electrode is formed of a metal wire adhered to the dielectric sheet or a metal film printed to or vapor deposited on the dielectric sheet.

10. The ionizer according to claim 1, further comprising a voltage generator for outputting an AC voltage to be applied to the primary section of the piezoelectric transformer, a sensor for measuring a charged potential level of the neutralized subject, and a control circuit which feedbacks a signal measured by the sensor to the voltage generator to control an ionic balance.

11. The ionizer according to claim 2, further comprising a voltage generator for outputting an AC voltage to be applied to the primary section of the piezoelectric transformer, a sensor for measuring a charged potential level of the neutralized subject, and a control circuit which feedbacks a signal measured by the sensor to the voltage generator to control an ionic balance.

12. The ionizer according to claim 10, wherein:

the voltage generator formed of a DC power supply, an oscillation circuit, and a semiconductor switching element for switching between opposing poles based on an output of the oscillation circuit is structured to output the AC voltage with a rectangular switching waveform; and the control circuit is structured to control a switching frequency of the voltage generator in accordance with a signal measured by the sensor.

13. The ionizer according to claim 11, wherein:

the voltage generator formed of a DC power supply, an oscillation circuit, and a semiconductor switching element for switching between opposing poles based on an output of the oscillation circuit is structured to output the AC voltage with a rectangular switching waveform; and the control circuit is structured to control a switching frequency of the voltage generator in accordance with a signal measured by the sensor.

14. A neutralization method using an ionizer with a piezoelectric transformer which includes a primary section to which a driving AC voltage is applied and a secondary section for generating a high voltage to have a thin metal wire-like ground electrode attached to an outer surface of the secondary section via a dielectric sheet for insulation in tight contact therewith; wherein:

the high voltage is generated in the secondary section by applying the AC voltage to the primary section of the piezoelectric transformer to generate a dielectric barrier discharge around the ground electrode on the dielectric sheet and to produce positive and negative ions; and concurrently an air flow is allowed to flow toward a neutralized subject from an air nozzle while passing a position where the ground electrode is disposed.

* * * * *